United States Patent [19]

Bradley et al.

[11] 4,344,120

[45] Aug. 10, 1982

[54] PLASTIC PAR LAMP CONSTRUCTION WITH TAPERED REINFORCEMENT

[75] Inventors: Irving Bradley, Novelty; James M. Hanson, Euclid, both of Ohio

[73] Assignee: General Electric Company, Schenectady, N.Y.

[21] Appl. No.: 61,911

[22] Filed: Jul. 30, 1979

[51] Int. Cl.[3] ..... F21V 7/00

[52] U.S. Cl. ..... 362/349; 362/61; 362/267; 362/299; 362/301; 362/329

[58] Field of Search ..... 362/211, 247, 267, 299, 362/329, 327, 341, 349, 263, 264, 294, 301, 306, 345, 61; 313/113; 264/248, 249

[56] References Cited

U.S. PATENT DOCUMENTS

| | | | |
|---|---|---|---|
| 3,184,353 | 5/1965 | Balmuth | 264/248 |
| 3,314,331 | 4/1967 | Wiley . | |
| 3,328,220 | 6/1967 | Harding | 264/248 |
| 3,705,380 | 12/1972 | Roberts | 264/249 |
| 3,725,698 | 4/1973 | Craig . | |
| 3,732,415 | 5/1973 | Lindae . | |
| 3,784,807 | 1/1974 | Boekkooi . | |
| 3,862,412 | 1/1975 | Postans | 362/341 |
| 3,885,149 | 5/1975 | Wolfe | 313/318 |
| 3,896,302 | 7/1975 | Whitney | 362/341 |
| 3,898,451 | 8/1975 | Murphy | 313/113 |
| 3,960,636 | 6/1976 | Moffitt | 264/248 |
| 3,986,914 | 10/1976 | Howard | 264/248 |
| 3,989,778 | 11/1976 | Osborne | 264/248 |
| 4,019,045 | 4/1977 | Bassett . | |
| 4,190,976 | 6/1978 | Hurt | 362/267 |
| 4,210,841 | 7/1980 | Vodicka | 313/113 |

*Primary Examiner*—Peter A. Nelson

*Attorney, Agent, or Firm*—John F. McDevitt; Philip L. Schlamp; Fred Jacob

[57] ABSTRACT

An improved plastic reflector member for a parabolic aluminized reflector (PAR) lamp is disclosed and, in particular, the use of said improved plastic reflector member for an all plastic PAR lamp or a PAR lamp which uses said improved reflector member. Said improved plastic reflector member utilizes a variable thickness wall member to form the parabolic shaped cavity wherein the wall thickness of its planar walls is sufficiently greater in the rim sealing region than in the adjoining wall region of said parabolic cavity to avoid mechanical and heat distortion.

8 Claims, 3 Drawing Figures

PLASTIC PAR LAMP CONSTRUCTION WITH TAPERED REINFORCEMENT

RELATED PATENT APPLICATION

U.S. patent application Ser. No. 58,061, filed July 16, 1979, in the names of James M. Hanson and Irving Bradley, which is now U.S. Pat. No. 4,282,565, and assigned to the present assignee, describes a sealed prefocused plastic mount construction for a plastic PAR lamp having the same general construction disclosed herein. More particularly, said plastic block mount comprises mating parts which define a cavity for receiving at least two lead wires of an associated light source with said cavity being filled with an elastomeric polymer providing a leak-proof enclosure. A further leak-proof seal is provided by the means employed to join said mount construction to the lamp reflector member. Locating or reference surfaces on the mount construction and reflector member cooperate to provide accurate positioning of the light source at the focus of said reflector member.

Another U.S. patent application Ser. No. 61,910, filed concurrently herewith in the name of James M. Hanson and assigned to the present assignee, describes a related, rectangular shaped plastic reflector member having a parabolic shaped cavity characterized by opposing generally parallel planes which intersect a parabolic contour and terminate in an outer sealing rim. Said reflector member further utilizes mounting pads of a hollow construction to avoid deformation of the parabolic cavity when said reflector member is formed, preferably by injection molding, as a unitary construction. Receptacle means are further disposed on the rear side of said reflector member to accommodate a prefocused mount construction which locates a light source at the focus of said reflector and said prefocused mount construction can have the same configuration as disclosed in said previously filed application.

Still another U.S. patent application Ser. No. 061,912, also filed concurrently herewith in the names of Irving Bradley and Vincent Vodicka, and assigned to the present assignee, describes the same general rectangular shaped plastic reflector member wherein the parabolic shaped cavity utilizes a variable thickness wall member such that the wall thickness is sufficiently greater in the apex region of said parabolic cavity than in the adjoining wall region to avoid mechanical and heat distortion. Said improvement can be incorporated in the improved PAR lamp construction of the present invention to represent a further improvement therein.

BACKGROUND OF THE INVENTION

A basic advantage for an all-plastic PAR lamp is its light weight as compared to the glass construction now in use. Consequently, a minimal wall thickness for said plastic PAR lamp construction is desirable to provide as little weight as possible while still recognizing that either mechanical and heat distortion of the plastic material both during lamp assembly and thereafter in use can give rise to a number of serious problems. Such a problem is experienced during assembly of an all plastic PAR lamp for an automotive headlamp construction where a reliable leak-proof seal is desired when the plastic lens member is joined to the reflector. Any mechanical or heat distortion at the sealing rim of said reflector member can preclude a reliable seal from being formed when either ultrasonic or vibration of welding techniques are used to provide the joinder. Subsequent heat distortion in the sealing rim region of the assembled construction during lamp operation at elevated temperatures can cause much the same problem in maintaining a leak-proof seal between the assembled members. Consequently, a more reliable sealing means for an all-plastic PAR lamp construction is desired which maintains the leak-proof seal both during lamp assembly as well as during subsequent lamp operation.

SUMMARY OF THE INVENTION

It is therefore an object of the invention to provide improved sealing means for an all-plastic PAR lamp having a rectangular shaped construction.

Another important object of the invention is to provide improved sealing means for the aforementioned lamp construction requiring only modest structural modification of the now existing reflector member.

Still another important object of the present invention is to provide modified structural means in the sealing rim region of a plastic rectangular shaped reflector member to accommodate the plastic weld flash encountered when the lens member of said PAR lamp is ultrasonically or vibrationally welded to the reflector.

These and other objects of the present invention are achieved by varying the wall thickness of the parabolic shaped cavity in a rectangular shaped plastic reflector member so that the wall thickness is sufficiently greater in the rim sealing region than in the adjoining wall region of said parabolic cavity to avoid mechanical and heat distortion. In a preferred embodiment, said reflector member is of a unitary molded construction, such as obtained by injection molding, with the increased thickness being provided by varying the draft angle for the planar walls of said molded construction in a known manner. In particular, the improved rectangular shaped plastic reflector member of the present invention includes a parabolic shaped cavity, one pair of opposed generally parallel planes which intersect the parabolic cavity to form the longer sides of said rectangular shape, a second pair of opposing generally parallel planes which intersect the parabolic cavity to form the shorter sides of said rectangular shape, all of said planes terminating at a rectangular shaped sealing rim, and receptacle means disposed on the rear side of said reflector which accommodates a prefocused mount construction to locate a light source at the focus of said reflector, wherein the improvement consists of having the wall thickness of the parabolic shaped cavity sufficiently greater in the sealing rim region than in the adjoining wall region to avoid mechanical and heat distortion.

A reflector lamp of the present invention utilizing the above described plastic reflector member further includes a prefocused mount which includes a light source located at the focus of said reflector being sealed to the receptacle means on said reflector and a lens member joined to the sealing rim of the reflector member. In a preferred embodiment of the prefocused light source mount being employed comprises at least two lead wires, at least two electrical connecting means joined one each to said lead wires, a plastic block having mating parts defining a cavity for receiving said joined lead wires and an elastomeric polymer to provide a leak-proof seal, and a light source connected to the end of said lead wires outside of said block. Said prefocused mount and light source assembly along with the means for joining said mount construction to a rectangular shaped plastic reflector member is already described in the aforementioned patent application Ser. No. 58,061, hence need only be further described in the present application to the extent of the improvements made herein. A preferred light source in the reflector lamp is a tungsten halogen incandescent lamp such as described in U.S. Pat. No. 4,139,794 which is assigned to the present assignee.

DESCRIPTION OF THE PREFERRED EMBODIMENTS

Figure 1:
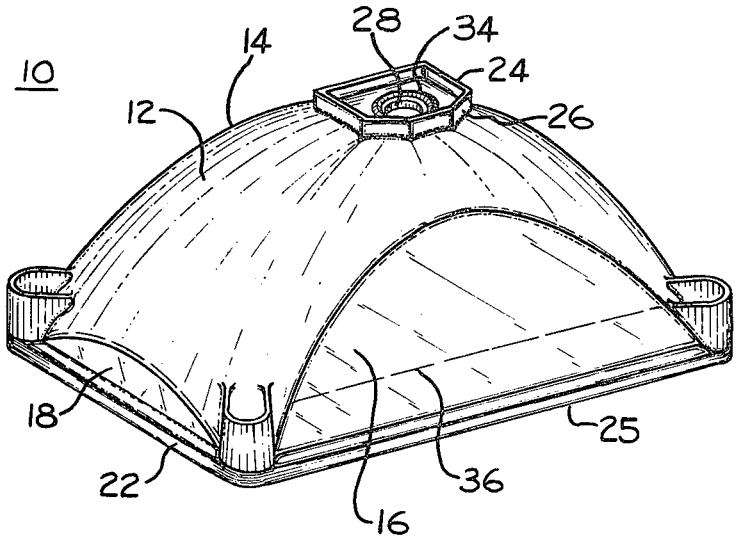
FIG. 1 is a perspective view of an improved rectangular shaped plastic reflector member constructed in accordance with the present invention.

Referring to FIG. 1, there is shown in perspective a rectangular shaped plastic reflector member 10 having a parabolic shaped cavity 12, one pair of opposing generally parallel planes 14 and 16 which intersect said parabolic cavity to form the longer side walls of said rectangular shape, a second pair of opposing generally parallel planes 18 and 20 which intersect said parabolic cavity to form the shorter sides or end walls of said rectangular shape, all of said planes terminating at a rectangular shaped sealing rim 22, and raised receptacle means 24 disposed on the rear side of said reflector to accommodate a prefocused mount construction (not shown) that locates a light source at the focus of said reflector member. A lens member (also not shown) can be sealed by conventional ultrasonic or vibration welding techniques to the front sealing surface 25 of said sealing rim on the reflector member. As shown, said receptacle means 24 which is disposed on the rear side of said reflector member comprises a box-like enclosure 26 into which the assembled plastic block mount and light source unit is fitted and which contains a central aperture 28 through which the light source extends after joinder. A circular raised wall portion 34 surrounds said central aperture opening 28 and furnishes a means to ultrasonically bond the assembled block mount to the receptacle means in a manner providing the desired leak proof seal. The increased wall thickness of the planar wall members in said reflector construction is shown by phantom line 36 which divides said heavier wall section from the adjoining wall regions in said reflector member.

Figure 2:
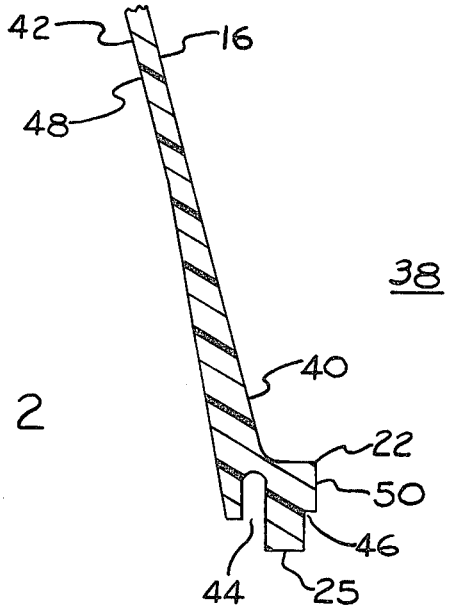
FIG. 2 is a partial cross sectional view of said reflector member which depicts the varied wall thickness of the parabolic cavity along with the further structural means utilized in the sealing rim region to accommodate melted plastic flash when a lens member is welded thereto.

FIG. 2 depicts in cross section the sealing rim region 38 of the above described reflector member wherein said sealing rim 22 is depicted as terminating at the outer edge of wall member 16. As can be noted, the wall thickness at point 40 in the sealing rim region is considerably greater than the wall thickness at point 42 in the adjoining wall region. Said wall thickness variation can easily be produced by simply varying the draft angle from that which would ordinarily be used when molding plastic articles in order to withdraw the molded article from the mold. As can be further noted from said drawing, the front sealing surface 25 of said sealing rim 22 is provided with depressions 44 and 46 which accommodate melted plastic flash when a plastic lens member is ultrasonically or vibrationally welded to the reflector member at said surface. Both longitudinally extending depressions in the front sealing surface of the sealing rim cooperate in precluding the plastic wall flash from either becoming deposited on the inner reflecting surface 48 of the reflector member or forming a deposit on the side edge 50 of the sealing rim 22 which can impair subsequent mounting of the completely assembled PAR lamp.

Figure 3:
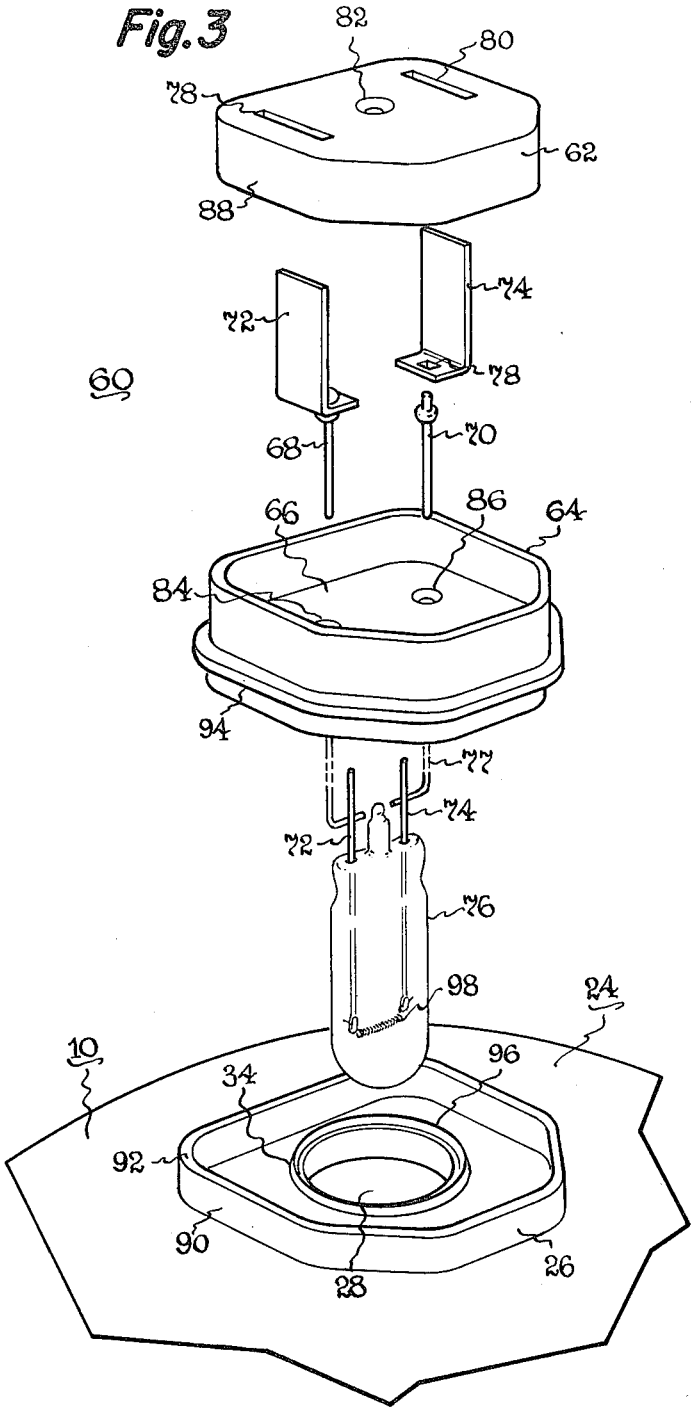
FIG. 3 is a perspective view of an unassembled mount construction according to the present invention which further includes parts of the reflector member to which said mount is assembled and the lamp device also assembled thereto.

Referring to FIG. 3 there is shown the unassembled parts of a prefocused mount and reflector lamp construction of the present invention. Accordingly, said mount construction 60 comprises an assembly of a plastic inner container member 62 which is fitted into an outer plastic housing member 64 to define an enclosed cavity 66 after being sealed together. A pair of lead wires 68 and 70 are joined to metal lug members 72 and 74, respectively, as electrical connecting means extending from opposite ends of the plastic mount construction and which serve to electrically connect the light source 76 to a suitable power supply (not shown). Each of said lead wires is mechanically joined to the L-shaped metal lug member by insertion into a square shape opening 78 and which is followed by mechanical deformation of the circular lead wire to prevent its rotation thereafter. Said lead wires 68 and 70 can also be joined to lamp in leads 72 and 74, respectively, by conventional crimping or welding preferably after bending 77 to impart added mechanical rigidity. The inner plastic block 62 which defines a cavity for receiving the joined lead wires includes a pair of slotted openings 78 and 80 for exit of the metal lug members along with an entrance opening 82 which permits the cavity to be filled with elastomeric polymer after mating with the outer housing member 64. Sealing means provided in this manner not only provides a leak-proof enclosure from the reflector member 10 after assembly thereto but further provides a leak-proof seal around the lead wires upon filling the channel openings 84 and 86 for said lead wires which lead to the interior of the reflector member. The elastomeric polymer can be injected into the cavity opening after the mating plastic parts have been assembled and preferably bonded together by ultrasonic welding at the periphery 88 of the inner member. The elastomer thus encapsulates the lugs and leads and, when cured, provides an adhesive seal between all surfaces to achieve the desired leak-proof enclosure.

The assembled mount construction 60 is suitably joined to reflector member 10 at the raised receptacle means 24 which is disposed on the rear side of said reflector. As previously stated, said receptacle means comprises a box-like member 26 into which the assembled plastic block mount is fitted and which contains a central aperture 28 through which the light source 76 extends after joinder. Wall portions 90 of the receptacle means furnish a support ledge 92 which accomodates the underside surface of a flange 94 extending outwardly from the assembled block mount after joined together as hereinafter described. The circular raised wall 34 which terminates in a peak 96 surrounds the central aperture opening 28 and furnishes the means to ultrasonically bond or otherwise adhesively join the assembled block mount to the receptacle means. The above overall described mount assembly achieves prefocusing of the light source for a reflector lamp in a dual manner for improved alignment of the light source at the focus of said reflector. Specifically, initial prefocusing of said light source is conducted by locating the lamp filament 98 at a predetermined distance from the underside referenced surface or datum plane that is provided by the flange portion 94 of the assembled block mount 60 when said light source is being joined thereto. A final prefocusing of the light source takes place when the assembled block mount and light source is thereafter joined to receptacle means 24 of the reflector member 10.

It will be apparent from the foregoing description to those skilled in the art that various modifications can be made in the above described preferred embodiments which are still within the spirit and scope of the present invention. For example, a variety of elastomeric polymers may be utilized providing they fulfill the condition that they adhere to either metal or plastic. Similarly, while the preferred plastic mount and light source unit has been described as having a generally rectangular shape in the form of box-like members, other suitable shapes such as cylindrical may be used providing the desired mount construction. It is also contemplated that suitable light sources include conventional incandescent lamps, tungsten halogen lamps or discharge lamps. It is intended to limit the present invention only by the scope of the following claims.

We claim:

1. An improved rectangular shaped plastic reflector member having a parabolic shaped cavity, one pair of opposing generally parallel planar walls which intersect the parabolic cavity to form the longer sides of said rectangular shape, a second pair of opposing generally parallel planar walls which intersect the parabolic cavity to form the shorter sides of said rectangular shape, all said planes terminating at a rectangular shaped sealing rim, and receptacle means disposed on the rear side of said reflector which accommodates a prefocused mount construction to locate a light source at the focus of said reflector, the improvement wherein the wall thickness of said planar walls is sufficiently greater adjacent to the sealing rim than in the adjoining wall region of said parabolic cavity to avoid mechanical and heat distortion, and wherein said greater thickness region is produced by varying the wall draft angle for said molded construction.

2. A reflector as in claim 1 which is of a unitary molded construction.

3. A reflector as in claim 1 wherein the front sealing surface of the sealing rim is provided with longitudinally extending depressions which accommodate melted plastic flash when a lens member is welded to the reflector member at said surface.

4. A reflector as in claim 3 wherein a pair of longitudinally extending depressions is provided on said front sealing surface.

5. A reflector member as in claim 1 wherein said prefocused mount includes a light source located at the focus of said reflector and said prefocused mount is sealed to the receptacle means of said reflector.

6. A reflector member as in claim 5 wherein the light source mount comprises a tungsten halogen lamp as the light source located at the focus of said reflector, at least two electrical connecting means joined one each to said lead wires, a hollow plastic block having mating parts defining a cavity for receiving said joined lead wires, an elastomeric polymer in the cavity of said block to provide a leak-proof seal around the lead wires, wherein the mating parts of said block comprise an inner container member defining said cavity and fitted into an inner housing member, said inner and outer members being sealed together after assembly to form a leak-proof enclosure, and said tungsten halogen lamp is externally connected to the end of said lead wires nearest to the focus of the reflector.

7. A reflector as in claim 5 wherein the front sealing surface of the sealing rim is provided with longitudinally extending depressions which accommodate melted plastic flash when said lens member is welded to the reflector member at said surface.

8. A reflector as in claim 7 wherein a pair of longitudinally extending depressions is provided on said front sealing surface.

* * * * *